United States Patent [19]

Vicino et al.

[11] 4,271,620

[45] Jun. 9, 1981

[54] ANIMATED THREE-DIMENSIONAL INFLATABLE DISPLAYS

[75] Inventors: Robert K. Vicino, 1355 6th Ave., San Diego, Calif. 92101; Calvin P. Owen, San Diego, Calif.

[73] Assignee: Robert K. Vicino, San Diego, Calif.

[21] Appl. No.: 43,092

[22] Filed: May 29, 1979

[51] Int. Cl.[3] ..... G09F 19/02

[52] U.S. Cl. ..... 40/406; 40/412; 40/414; 40/477; 40/624; 46/87

[58] Field of Search ..... 40/412, 406, 417, 421, 40/477, 414, 419, 603, 624; 46/87, 88, 89, 90

[56] References Cited

U.S. PATENT DOCUMENTS

| | | | |
|---|---|---|---|
| 1,098,303 | 5/1914 | Steiner et al. | 46/88 |
| 1,352,047 | 9/1920 | Boje, Jr. | 46/87 X |
| 1,764,834 | 6/1930 | Gatliff | 40/624 |
| 1,916,988 | 7/1933 | Dieschke | 46/87 X |
| 2,047,377 | 7/1936 | Liwschutz | 40/412 X |
| 2,065,473 | 12/1936 | Liwschutz | 40/412 |
| 2,348,250 | 5/1944 | Gardner et al. | 46/87 X |
| 2,643,598 | 6/1953 | Carroll | 46/87 UX |
| 2,667,001 | 1/1954 | Sheridan | 40/406 |
| 3,686,782 | 8/1972 | Erickson et al. | 46/87 X |
| 3,771,247 | 11/1973 | DeHarak | 46/87 X |
| 4,038,777 | 8/1977 | Schwartz | 46/87 |
| 4,123,865 | 11/1978 | Pearson | 40/414 |

*Primary Examiner*—John F. Pitrelli
*Assistant Examiner*—G. Lee Skillington
*Attorney, Agent, or Firm*—Henri J. A. Charmasson

[57] ABSTRACT

A three-dimensional figure made from an inflatable, sculptured envelope of soft pliable material into which is blown a constant flow of ambient air wherein said flow of ambient air can be modulated or reversed to cause a lifelike movement of the sculptured figure. The inflatable envelope can be attached to the face of a billboard to create a three-dimensional display which can be quickly assembled or dismantled. The structure can tolerate substantial leakage of air from the envelope along seam lines, through the pliable material fabric or small puncture holes.

9 Claims, 32 Drawing Figures

ANIMATED THREE-DIMENSIONAL INFLATABLE DISPLAYS

BACKGROUND OF THE INVENTION

The sheer proliferation of billboards and advertising signs along the highways and city streets has lessened the impact of this form of commercial advertising on the minds of the passersby. Advertising agencies have tried to improve the attention-getting quality of their displays by creating three-dimensional, lifelike designs which appears to escape the confines of the two-dimensional billboard. Other advertisers have tried to animate their billboards with moving components. However, the creation of three-dimensional figures commensurate with the gigantic dimensions of billboards require large quantities of materials and very complex supporting infrastructures. Although the use of inflatable structures, because of their light weight and simplicity of construction, would seem to be ideally adapted to the construction of three-dimensional billboards they have been found to be too vulnerable to the atmospheric elements. Changes in ambient temperature can cause a substantial size variation in a sealed inflated structure. The plastic laminated material necessary to provide an airtight inflatable enclosure tends to deterioriate quickly under the effect of solar radiation.

SUMMARY OF THE INVENTION

The first principal object of this invention is to provide an inflatable sculptured structure which may be attached to the face of an advertising billboard in order to create a three-dimensional display thereon.

The second principal object of this invention is to create a three-dimensional billboard display which can easily be given lifelike animation.

It is also a main object of this invention to provide such an inflatable structure made of soft pliable material which is not necessarily airtight.

A further object of this invention is to provide various techniques for the mounting of such three-dimensional structures on a vertical billboard. These and other objects of the invention are achieved with an inflatable, collapsible envelope made of soft pliable material which is subject to a constant input of lightly pressurized cold air from a blower. The cold air is continuously leaked out of the inflated envelope through bleeding holes or through the porous skin material. The input flow of cold air is modulated to cause a controlled collapsing of certain parts of the structure in order to create the impression of lifelike movement therein.

DESCRIPTION OF THE PREFERRED EMBODIMENTS OF THE INVENTION

Figure 1:
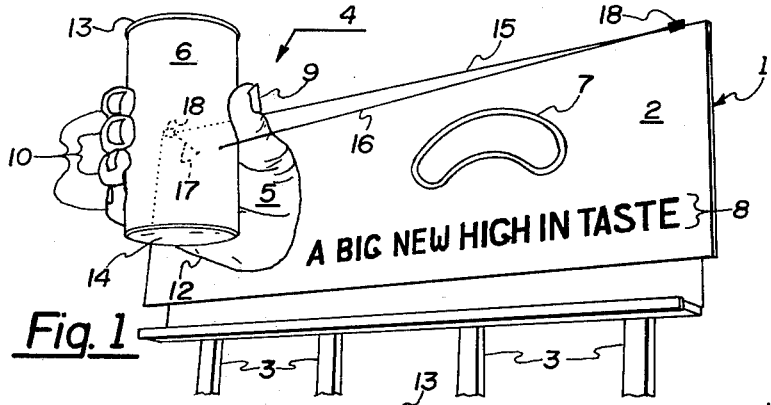
FIG. 1 is a perspective view of a three-dimensional billboard with an animated structure shown in a first position.

Referring now to the drawing and more specifically to FIGS. 1 through 8, there is illustrated a three-dimensional Billboard 1 mounted on post 3. The Billboard 1 comprises a planar frame 2 and a projecting animated structure 4. The animated structure 4 is made of two inflated envelopes 5 and 6. The first envelope 5 which is secured to the face of the board 2 is sculptured to represent a human hand.

The second inflated envelope is sculptured to represent a beverage can having circular top 13 and base 14 held between the thumb 9 and fingers 10 end palm 12 of the hand 5. The two envelopes 5 and 6 are of a soft pliable material made of tightly woven synthetic fibers. The envelopes 5 and 6 form two chambers, A and B, respectively, which are not completely airtight due to the nature of the woven material. Chamber A which occupies the inside of the hand-shaped envelope 5 as a intake orifice 31 which opens into a pair of ducts 40. One of the ducts leads to a first blower 38 which draw ambient air through the orifice 31 into the chamber A. The second duct leads to a bi-directional blower 39 which can either draw air from the outside through orifice 31 then through ducts 41 into chamber B which is formed by the inside of the can-shaped envelope 6; or suck air out of chamber B toward the outside.

Figure 5:
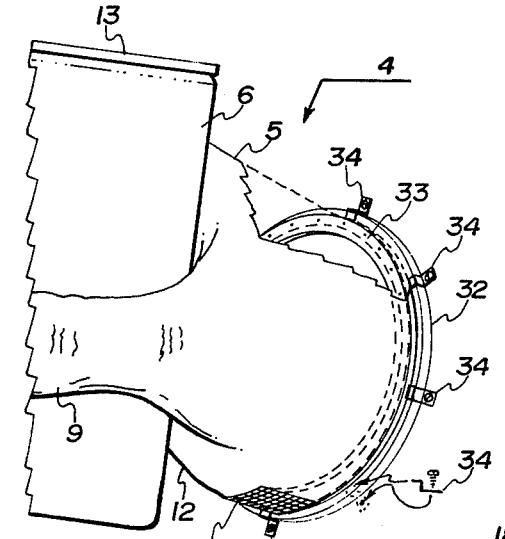
FIG. 5 is a partial detail view of the animated structure shown in FIG. 1 with a cutaway portion showing a first type of billboard attachment.

Illustrated in FIG. 5 is a first method for attaching the hand-shaped envelope 5 to the face of the billboard 2. The edges of the envelope 5 are pinched under an inside ring 33 fastened to an outside ring 32. The outside ring 32 has a wider rim which forms a small shoulder extending beyond the inside ring 33, and is secured to the face of the billboard by a series of brackets 34 held in place by wood screws. This method of attachment provides for a quick separation of the envelope from the face 2 of the billboard.

Figure 6:
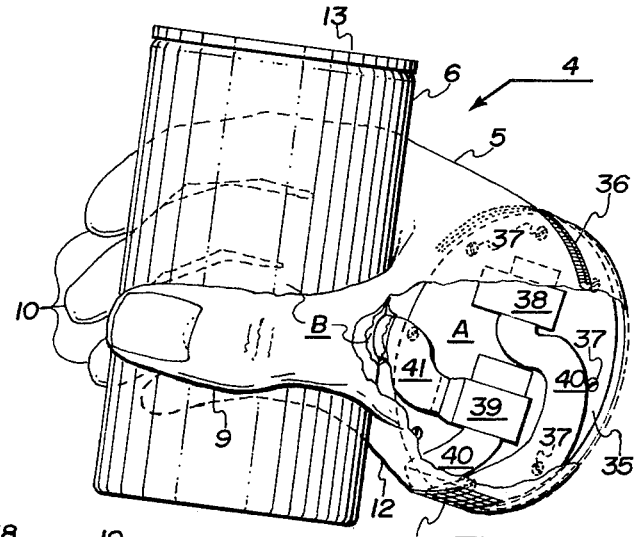
FIG. 6 is a perspective view of the animated structure shown in FIG. 1 with a cutaway portion showing a second type of billboard attachment and the functional components.

FIG. 6 illustrates a second method for attaching the envelope 5 to the face 2 of the billboard. In this second embodiment the edges of the envelope 5 are caught between the face of the billboard 2 and circular member 35 which is secured against the face of the billboard 2 by wood screws 37. The blowers 38 and 39 which in the previous embodiment were mounted directly against the face 2 of the billboard are now mounted on the circular member 35. A zippered opening 36 provides access to the chamber A for installation and maintenance of the blowers 38 and 39.

Figure 7:
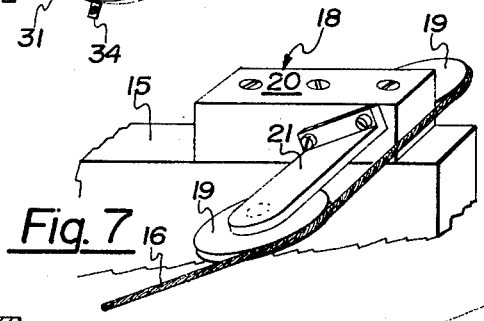
FIG. 7 is a perspective enlarged view of a edge-mounted pulley assembly.
Figure 11:
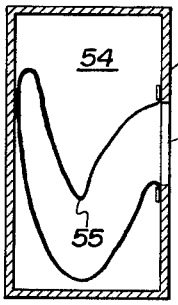
FIG. 11 is a cross-sectional view of the embodiment of FIG. 10 shown in a second position.
Figure 10:
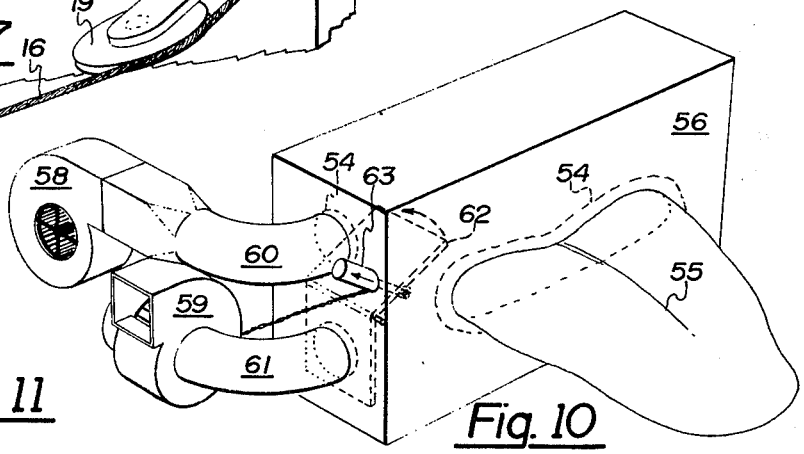
FIG. 10 is a perspective view of a second embodiment of the invention shown in a first position.

Animation of the three-dimensional structure is achieved by modulating the flow of air into chambers A and B through control of the blowers 38 and 39. Tethers 16 and 17 provide additional assistance in the movement and support of the sculptured structure 4. The tethers 16 and 17 are attached to the wall of the envelope 6 and run over the top edge 15 of the billboard through a set of double pulley assemblies 18 and are both connected to a winch 23 in the back of the billboard. The winch 23 is driven by a bi-directional motor 24. When the winch 23 is activated one of the tethers 16 or 17 is wound around the winch 23 while the other tether is unwound. This applies a lateral pull on the structure 4 causing it to twist to one side. A resilient tensioner 22 is mounted on each tether 16 and 17 in order to accommodate the difference in tension due to the uneven geometry of the animated structure 4. Both tethers 16 and 17 can also be pulled back together to assist in the vertical movement of the sculptured structure 4. This is accomplished by means of a seesaw lever 26. A pulley 29 at the end of each arm of the seesaw lever 26 captures a section of the tether between two stationary pulleys 30. One arm of the seesaw lever 26 is linked by means of connecting rod 27 to the rotary arm 28 of a motor 25. For each turn of the rotary arm 28, the tethers 16 and 17 are alternately pulled and released, thus causing vertical movement of the sculptured structure 4. The pulley assemblies used to hold the tethers 16 and 17 as they ride above the top 15 of the billboard are illustrated in FIG. 7. The supporting block 20 is fastened to the top edge 15 of the billboard. Projecting from the block 20 towards the front and back of the billboard are two brackets 21 supporting pulleys 19 which are slanted toward the area where the tethers 16 and 17 are attached to the sculptured FIG. 4.

Figure 2:
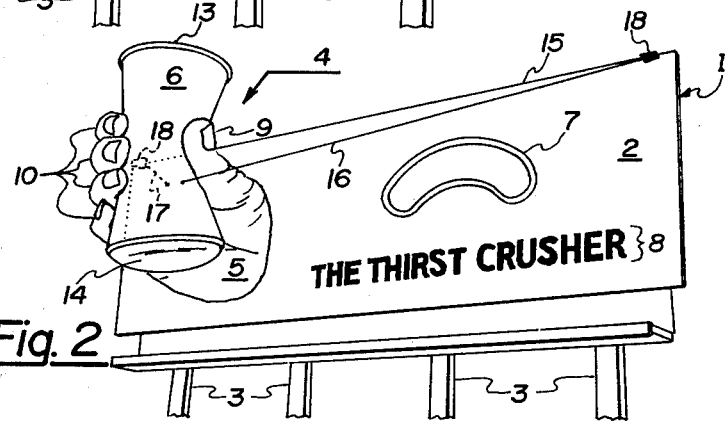
FIG. 2 is a perspective view of the billboard shown in FIG. 1 with the animated structure shown in a second position.
Figure 3:
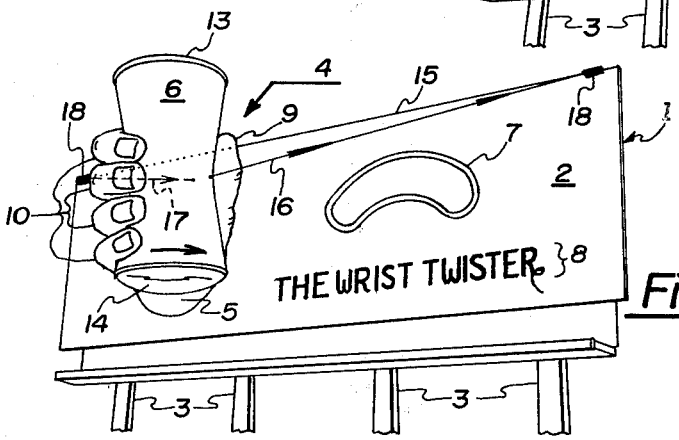
FIG. 3 is a perspective view of the billboard shown in FIG. 1 with the animated figure shown in a third position.
Figure 4:
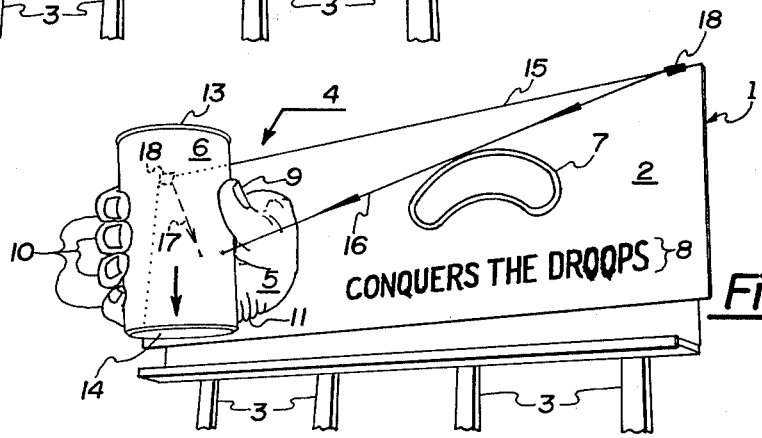
FIG. 4 is a perspective view of the billboard shown in FIG. 1 with the animated figure shown in a fourth position.
Figure 9:
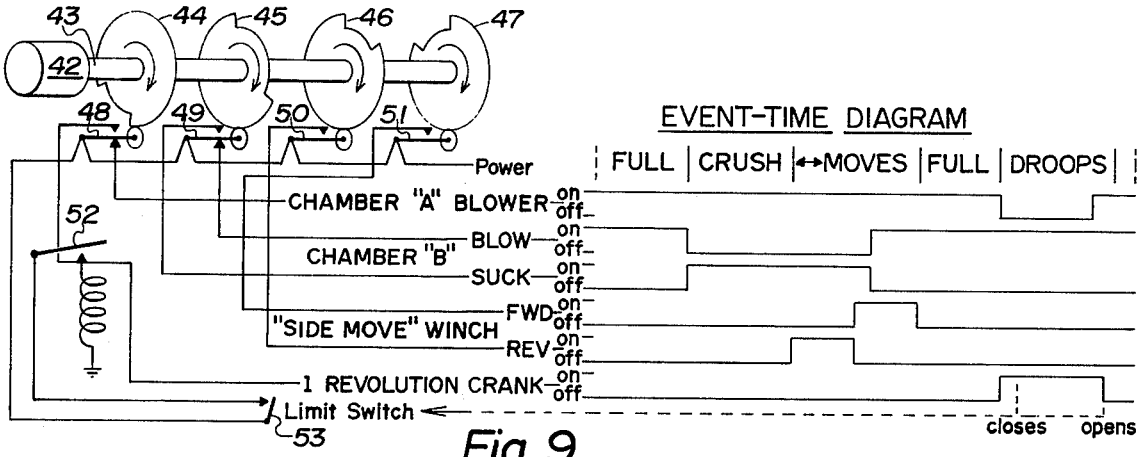
FIG. 9 is a diagrammatical representation of the control system.

The control and timing sequences for the animation of the sculptured structure 4 are illustrated in FIG. 9. A timing motor 42 drives a shaft 43 upon which are mounted several cams 44, 45, 46 and 47. These cams control a series of switches 48, 49, 50 and 51 which activate or deactivate the blowers 38 and 39, the winch motor 24 and the seesaw lever motor 25. The cams and switches are illustrated in the reset or static position during which the sculptured FIG. 4 is immobile with the two chambers A and B fully inflated. The power applied through switches 48 and 49 cause blowers 38 and 39, respectively, to maintain a steady flow of cold air into chambers A and B. The amount of air which escapes through the woven material that makes the envelopes 5 and 6 is more than compensated by the action of the two blowers. As the shaft 43 continues its clockwise rotation, switch 49 is tripped by cam 45 causing the blower 39 to change direction and to suck air out of chamber B. Envelope 6 representing the can, which is subjected to lateral pressure from the thumb 9 and the fingers 10 which remain fully pressurized, begins to collapse. The impression as illustrated in FIG. 2 is thus created of the hand crushing the can. As cam 46 trips switch 50, the winch motor 24 is turned on causing a lateral movement of the entire sculptured figure. Then as cam 47 trips switch 51 the winch motor direction is reversed and the hand can figure is returned to the rest position. During the return maneuver, cam 45 causes the blower 39 to change direction and again blow air into chamber B. The envelope 6 regains its normal, fully inflated state. Cam 44 soon trips switch 48 which energizes motor 25 putting in motion the seesaw lever 26, while blower 38 is shut off. The drop of pressure within envelope 5 and the release of tethers 16 and 17 cause the sculptured figure to droop slightly as illustrated in FIG. 4 with buckling ridges 11 forming in the lower section of envelope 5. As the seesaw lever begins to move, the normally closed switch 53 located below one arm of the seesaw lever 26 is deactivated. The closure of the switch 53 keeps motor 25 energized until a full revolution has been accomplished and switch 53 is reopened by contact with the arm of the seesaw lever 26. In the meantime, switch 48 has been tripped by cam 44 and the animation time sequence is started anew. A greater impact upon the viewers of the animated billboard can be achieved if the written message 7 and 8 on the face 2 of the billboard can be adapted to each phase of the animation sequence as shown in FIGS. 1 through 4.

Figure 14:
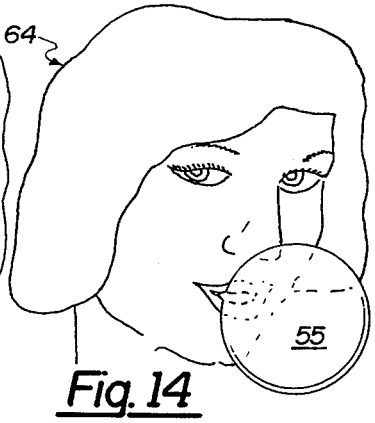

A second example of pneumatic, three-dimensional animation for billboards is illustrated in FIGS. 10 through 14. In this particular embodiment a display figure 64 which may be either two-dimensional or three-dimensional, may be caused to project an inflatable extension 55 through an orifice 57 and alternately to withdraw the extension into the orifice behind the figure 64. In this case, the figure 64 represents the head of a lady which can be made to stick her tongue out or blow bubble gum. The inflatable extension 55 is fastened to an orifice 57 in the wall 56 of a closed, rigid chamber 54. The chamber 54 may be located behind the billboard or housed within the figure 64 itself in case of a three-dimensional representation. A first blower 58 is designed to blow air into the chamber 54 and extension 55. A second blower 59 is wired so that it will cause air to be drawn out of the chamber 54 and extension 55. A gate 62 controlled by a solenoid 63 can alternately close the exhaust duct 60 of blower 58 or the intake duct 61 of blower 59. When blower 58 is activated gate 62 closes the duct leading to blower 59. The extension 55 can first be extended in the shape of a tongue and as pressure continues to build within it to expand in the form of a bubble as shown in FIG. 14. When blower 58 is shut off and blower 59 is activated the air is sucked out of the inflatable extension 55 which first collapses and is soon withdrawn within chamber 54 as the air pressure continues to drop therein.

Figure 15:
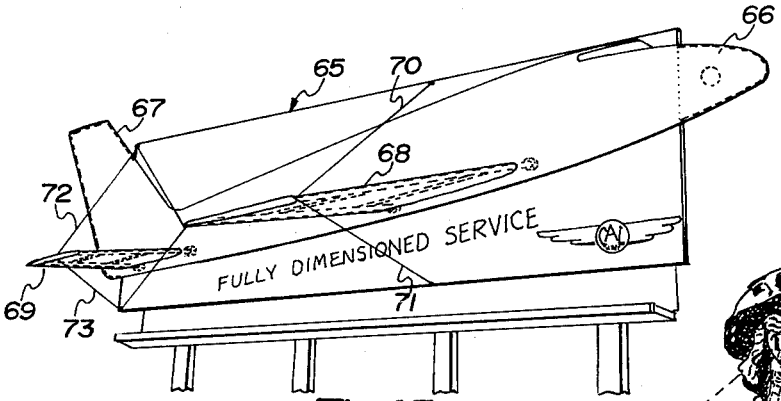
FIG. 15 is a perspective view of a third embodiment of the invention.

FIG. 15 illustrates a third embodiment of the invention in which the three-dimensional display 65 with lateral projections 66 and 67 represents an airplane. The body of the plane is an inflated structure which with horizontal projections representing the wing 68 and stabilizer 69. These projections are also inflatable but are supported with tethers 70, 71 and 72, 73. Animation may be achieved by slightly inflating the wing 68 and stabilizer 69 and driving the tethers 70, 71 and 72, 73 by means of a winch mechanism as described in the first embodiment of the invention.

Figure 16:
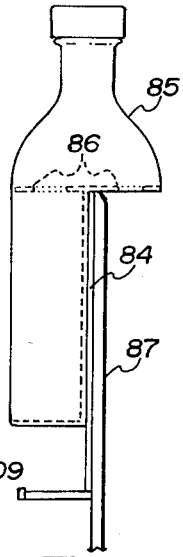
FIG. 16 is a side view of a fourth embodiment of the invention.
Figure 31:
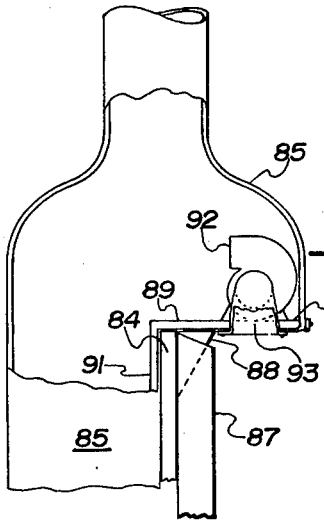
FIG. 31 is a partial enlarged view of the third embodiment of the invention with a cutaway portion showing some of the structural and functional elements.

FIG. 16 represents a fourth embodiment of the invention in which an inflatable structure 85 representing a bottle is made to project from the face and above the billboard 84 mounted on post 87. In this particular application two separate, inflatable chambers are created by a circular septum 86. The circular septum 86 also acts as the main bracing element and rests against the top edge of the billboard 84. An alternate method for mounting the bottle 85 is illustrated in FIG. 31. In this embodiment, the entire bottle 85 forms a single chamber in which air pressure is maintained by blower 92. The principal structure element is a semi-circular shelf 89 with a downward square projection 91 fastened to the face of the billboard 84. The shelf 89 rests on the top edge of the billboard 84 and on a series of square brackets 88. The air intake 93 is located underneath the cantilevered portion 90 of the shelf 89. Animation may be achieved by having a first transparent envelope defining the outline of the bottle 85; and by having a second, opaque, inflatable envelope housed within the bottom part of the bottle 85. Independent inflation and deflation of the opaque envelope will give the impression of a liquid content in the bottle 85 with level rising and dropping as the air pressure is modulated in and out of the internal envelope.

Figure 17:
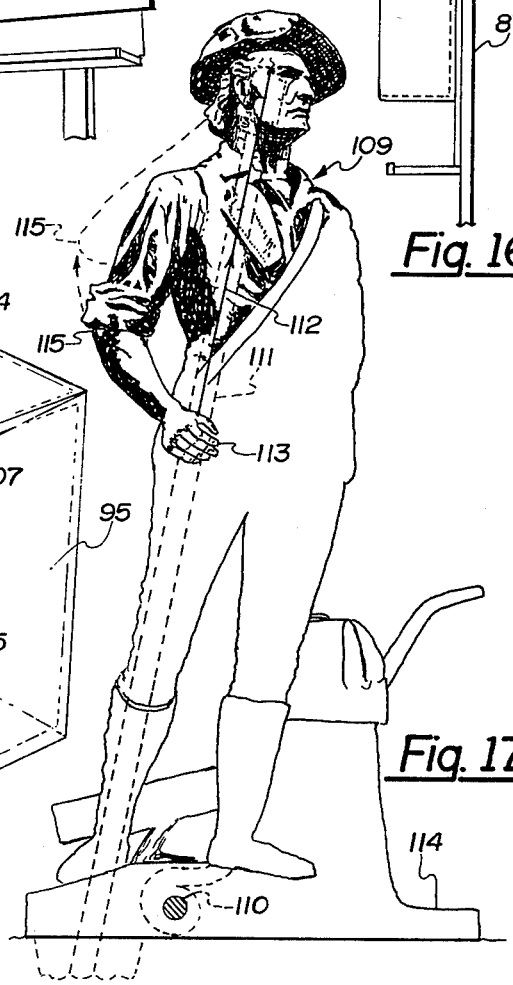
FIG. 17 is a front elevation of a fifth embodiment of the invention

A fifth embodiment of the invention is illustrated in FIG. 17. A vertical figure 109 delineated by an inflatable envelope which may have gigantic proportions is braced from within by a rigid column 111 which is anchored into the ground. A blower 110 located within the rigid base 114 is used to inflate the structure and to maintain a constant flow of air therein. Animation is achieved by partially deflating a separate chamber with the right arm in order to create a flexible area around the elbow 115. The hand 113 is pulled by means of a tether 112 toward a hole located in the temple area. The tether 112 is controlled by a winch and motor located within the structure as taught in the previously described embodiments of this invention.

Figure 18:
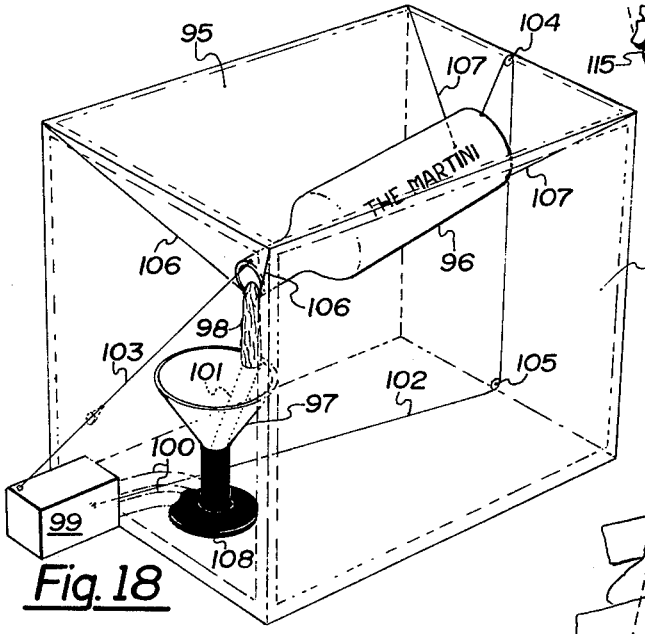
FIG. 18 is a perspective view of a sixth embodiment of the invention.

FIG. 18 illustrates a sixth embodiment of the invention in which mechanical and pneumatic techniques described above are used to create animation. A cubical, inflatable envelope 95 made of transparent material is maintained under a constant flow of air generated by a blower located in the housing 99. A second inflated enclosure 96 representing a tilted bottle is suspended within the cubicle structure 95 by a series of tethers 106 and 107. A flow of air generated in the housing 99 is fed to the inside of the bottle-shaped enclosure 96 through duct 100, 101 and 98. Duct 101 is made of transparent material and runs along the glass-shaped plastic structure 97. Duct 98 is hidden within a flow of tinsel-like material simulating the liquid pouring off the bottle 96 into the glass 97. A third inflatable closure 108 made of opaque material is housed within the foot of the glass 97. The opaque enclosure 108 is independently inflated and deflated to simulate the change in liquid level within the glass 97. The bottom of the bottle 96 may be raised or lowered by means of a tether 102, 103 riding on pulleys 104 and 105 and pulled by a winch and motor package within housing 99. Transparent rigid elements are used along the edtes of the cubicle enclosure 95 in order to maintain its angular shape.

Figure 19:
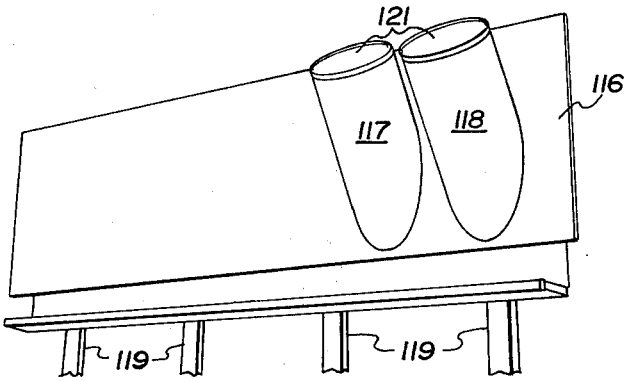
FIG. 19 is a perspective view of a seventh embodiment of the invention.
Figure 20:
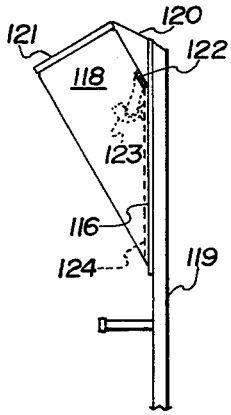
FIG. 20 is a side view of the embodiment shown in FIG. 19.
Figure 21:
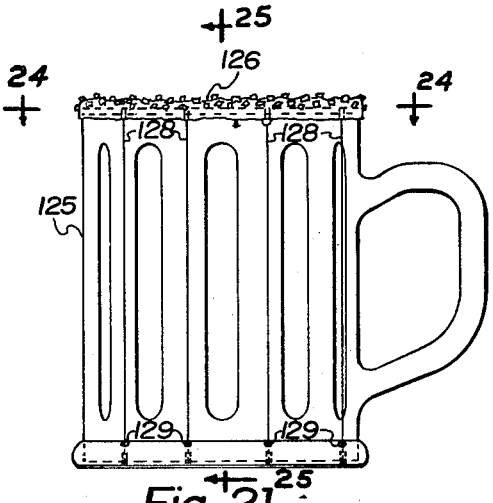
FIG. 21 is a front view of an eighth embodiment of the invention shown in a first position.
Figure 22:
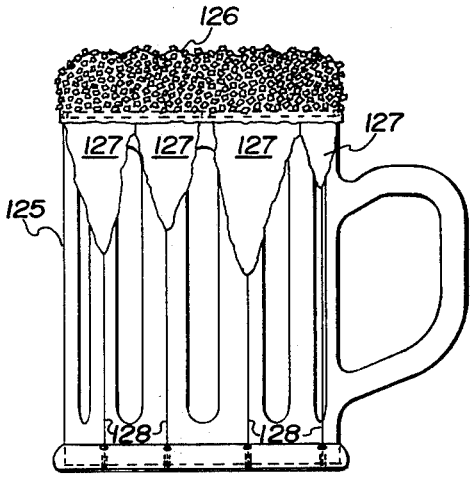
FIG. 22 is a front elevation view of the embodiment illustrated in FIG. 21, shown in a second position.
Figure 8:
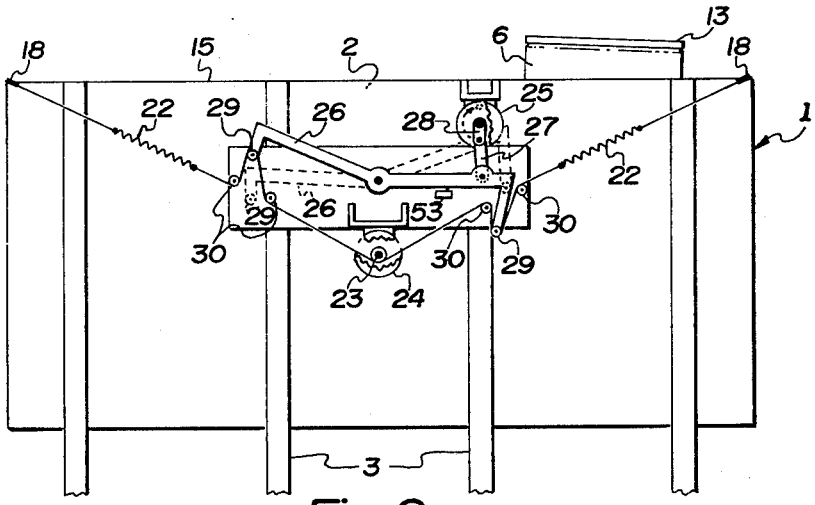
FIG. 8 is a back view of the billboard shown in FIG. 1.
Figure 12:
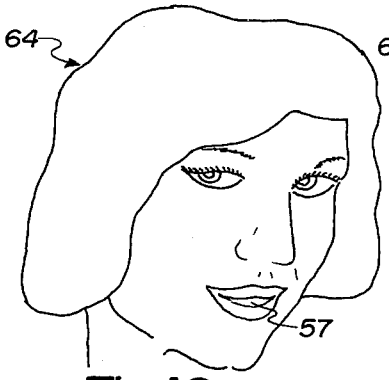
FIGS. 12, 13 and 14 illustrate three different applications of the embodiment described in FIGS. 10 and 11.
Figure 13:
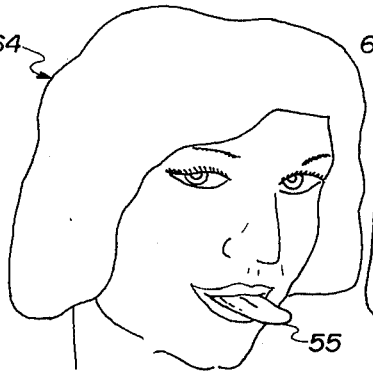

FIGS. 19 and 20 illustrate a seventh embodiment of the invention in which cylindrical inflated structures 117 and 118 are mounted with ring 124 in a slanted position against the face of a billboard 116 mounted on posts 117. This embodiment is remarkable in that a voluminous three-dimensional effect can be achieved upon the viewer by a relatively simple and small inflated element. This effect is due to the angular position of the inflated structures 117 and 118 in relation to the face of the billboard 116. A triangular bracing element 120 can be used to secure the rigid top 121 of the structures to the face of the billboard. The blower 123 is mounted within the structure against the billboard face and the air intake 122 is located on the side of the cylindrical structure facing the billboard.

An eighth embodiment of the invention is shown in FIGS. 21 through 25. This form of display comprises a first inflatable structure 125 shaped like a beer mug and mounted against a face of a billboard. A second inflatable enclosure is mounted on a shelf on top of the first enclosure 125. The second enclosure is sculptured to represent foaming suds and is inflated or deflated by means of a blower 133. The shelf supporting the second enclosure has a frontal overhang which hides a storage space 138 between the top of the first enclosure and the supporting shelf of the second enclosure 126. Folded within the storage space are a series of tongue-shaped extensions 127 made of pliable plastic material. Each extension 127 is connected in two places 130 and 131 to one of a series of tethers 128. Each tether 128 runs vertically down the face of the mug-shaped structure 125 between two pulleys 136 and 137, then through holes 129, under the structure and back towards a winch 132. The upper end of each tether 128 runs on top of the mug-shaped structure 125 and down towards the winch 132. When driven by motor 135, the winch causes each of the extensions to drop down from what appears to be the brim of the beer mug along the side. At the same time the upper enclosure 126 is inflated. The overall display takes the appearance of a beer mug which developes a head of suds spilling over the side. The operation of the winch 132, the uni-directional blower 134 and the bi-directional blower 133 is in accordance with the technique disclosed in the description of the first embodiment of the invention. When the direction of the winch 132 is reversed the tongue-shaped extensions 127 are pulled back and folded within the storage space 138. In the meantime, air is sucked out of the upper structure 126.

Figure 26:
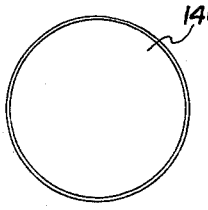
FIG. 26 is a cross-sectional view of a unrestricted inflated spherical envelope.
Figure 27:
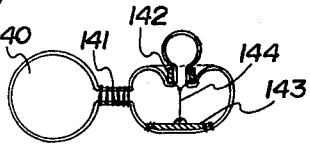
FIG. 27 is a cross-sectional view of the inflated envelope of FIG. 26 with various type of restraints.
Figure 28:
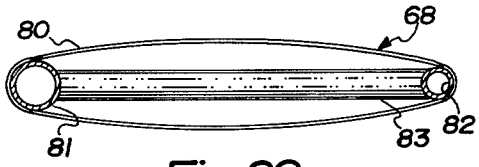
FIG. 28 is a cross-sectional view of the airplane wing shown in FIG. 15.
Figure 29:
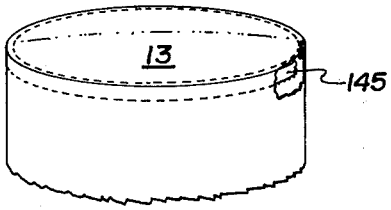
FIG. 29 is a perspective view of a first type of cylindrical structure top used in the first embodiment of the invention.
Figure 30:
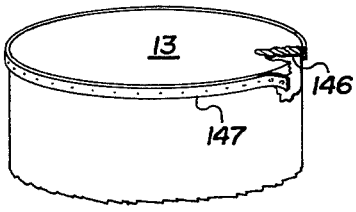
FIG. 30 is a second type of cylindrical structure top used in the first embodiment of the invention.
Figure 32:
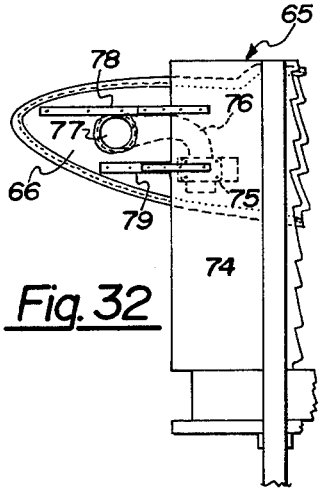
FIG. 32 is a partial back view of the third embodiment of the invention.
Figure 23:
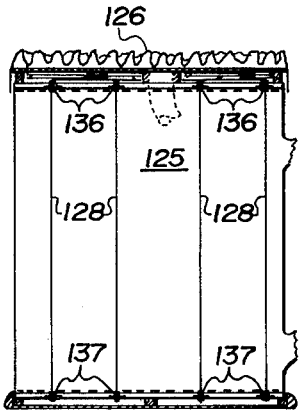
FIG. 23 is a median cross-sectional view of the embodiment of the invention shown in FIG. 21.
Figure 24:
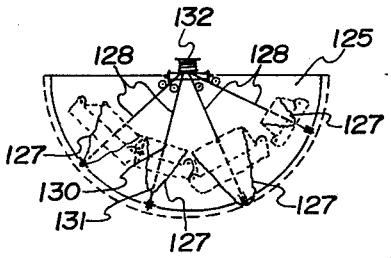
FIG. 24 is a top cross-sectional view taken along line 24—24 of FIG. 21.
Figure 25:
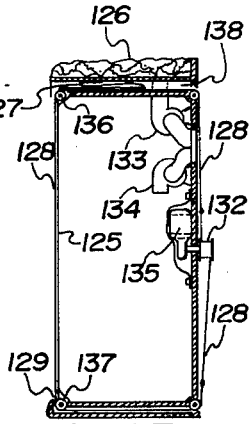
FIG. 25 is a side cross-sectional view taken along line 25—25 of FIG. 21

Illustrated in FIGS. 26 through 30 are various techniques used in shaping inflatable envelopes into specific forms. FIG. 26 shows the spherical form 140 taken by a unrestrained, inflatable, resilient envelope. In FIG. 27 the same envelope 140 has been subject to a variety of shaping devices. A series of rings 141 may be used to create a tubular form. A circular platform 143 fastened to the bottom creates a flat base. A ring 142 anchored internally to the platform 143 by tie 144 is used to mold this part of the inflated envelope 140 into a particular shape. FIG. 28, which might be a cross-sectional view of the wing of the third embodiment of the invention illustrated in FIG. 15, shows the infra structure used to support such a projection. The inflated circular envelope 80 is maintained in a flat, elongated shape by two tubular beams 81 and 82 spaced at regular intervals by orthogonal braces 83. FIG. 29 illustrates a first method for shaping the circular top of a structure such as the one discussed in the first and seventh embodiment of the invention. A rigid ring 145 is fastened to the edge of the inflated structure. The ring will not prevent the top 13 from bulging out under the effect of the compressed air confined in the structure. FIG. 30 illustrates a second method for shaping the top of a cylindrical structure. A rigid circular top 146 is secured inside the inflatable envelope by a tape 147 nailed into the edge of the rigid circular top 146. FIG. 32 illustrates the method used to extend a three-dimensional structure beyond the lateral edges of a billboard 65. This method is applicable to the construction of the third embodiment of the invention illustrated in FIG. 15. A planar extension to the billboard 65 is supported by braces 78 and 79 bolted to the back 74 of the billboard 65. The intake hole 77 opens into a duct 76 leading to the blower 75. The nose portion of the airplane envelope is stapled to the edges of extension 66.

Every one of the inflatable structures described herein may be made out of an air-tight, laminated, plastic material rather than from a woven cloth. In such case it would be necessary to provide bleeding holes preferably along seams in order to relieve the air pressure build-up within the inflated envelope.

While several embodiments of this invention have been described and various techniques of implementation have been suggested, other embodiments may be devised and modifications may be made thereon without departing from the spirit of the invention and the scope of the appended claims.

What is claimed is:

1. A three-dimensional display suitable for outdoors, roadside advertising which comprises:

a billboard having a generally vertical, planar message-carrying surface;

a sculptured, collapsible envelope made of soft, pliable material in a plurality of sections sewn together, said sections being shaped and dimensioned to assume the outline of a predetermined item when said envelope is inflated;

said envelope having an opening and at least one air-bleeding hole;

means for attaching a portion of said envelope surrounding said opening to said planar surface; and means mounted on said billboard for continuously blowing ambient air into said envelope at a sufficient flow rate to keep said envelope inflated.

2. The structure claimed in claim 1 wherein said envelope is made of air-tight laminated material.

3. The structure claimed in claim 1 wherein said means for blowing is a motor-driven blower mounted within said envelope and against said planar surface, said motor-driven blower drawing ambient air through said opening.

4. The structure claimed in claim 3 wherein said means for attaching comprise a rigid circular member fastened against said planar surface, the peripheral edge of said portion being pinched under said circular member.

5. A three-dimensional display suitable for outdoors, roadside advertising which comprises:

a billboard having a generally vertical, planar message-carrying surface;

a first sculptured collapsible envelope made of soft, pliable material in a plurality of sections sewn together, said sections being shaped and dimensioned to assume the outline of a pre-determined item when said envelope is inflated;

said envelope having an opening;

means for attaching a portion of said envelope surrounding said opening to said planar surface;

a motor-driven blower mounted against said planar surface within said envelope, continuously moving ambient air into said envelope;

a second sculptured, collapsible envelope made of soft, pliable material having an intake orifice and at least one exhaust hole;

means mounted against said planar surface, within said first envelope, for moving ambient air into said second envelope;

means for attaching said second envelope to said first envelope; and means, associated with said means for moving ambient air into said second envelope, for modulating the flow of ambient air into said second envelope.

6. The structure claimed in claim 5 which further comprises:

at least one tether having a first end attached to said second envelope; and stationary mounted means for pulling said tether and for applying a moving force to said envelope.

7. The structure claimed in claim 6 wherein:

said means for moving air into the second envelope comprise at least one blower and a motor driving said blower;

said means for modulating comprise meams for alternately turning the motor on and off;

said means for pulling comprise:

a winch mounted on the back of said planar surface and connected to said tether; and means for alternately turning the winch in opposite directions.

8. The structure claimed in claim 7 wherein said means for pulling further comprise:

a second tether having a first end attached to said second envelope and a second end wound around said winch in a direction opposite to the winding of said first tether;

a plurality of pulley means for guiding said tethers in opposite direction, away from the winch; and means for simultaneously deflecting each tether from its linear travel between two of said pulleys.

9. A three-dimensional display suitable for outdoors, roadside advertising which comprises:

a billboard having a generally vertical planar message-carrying surface;

a sculptured, collapsible envelope made of soft, pliable material in a plurality of sections sewn together, said sections being shaped and dimensioned to assume the outline of a predetermined item when said envelope is inflated;

said envelope having an opening;

means for attaching a portion of said envelope surrounding said opening to said planar surface;

a motor driven blower mounted against said planar surface, within said envelope, continuously moving ambient air into said envelope;

wherein said envelope comprises a zippered slot opening shaped and dimensioned to provide maintenance access to said motor-driven blower.

* * * * *